US005307060A

United States Patent [19]

Prevulsky et al.

[11] Patent Number: 5,307,060

[45] Date of Patent: Apr. 26, 1994

[54] EMERGENCY VEHICLE ALERT SYSTEM

[76] Inventors: Sy Prevulsky, 16 Deer Creek La., Laguna Hills, Calif. 92653; Tony Griego, 4500 Campus Dr., Ste. 131, Newport Beach, Calif. 92660

[21] Appl. No.: 852,312

[22] Filed: Mar. 17, 1992

[51] Int. Cl.[5] ..... G08G 7/00

[52] U.S. Cl. ..... 340/902; 340/901; 340/903; 340/436

[58] Field of Search ..... 340/901, 902, 903, 906, 340/961, 435, 436, 460, 474; 367/909; 455/58.1, 54.1

[56] References Cited

U.S. PATENT DOCUMENTS

| | | | |
|---|---|---|---|
| 2,146,724 | 2/1949 | Dunmore | 340/961 |
| 3,173,137 | 3/1965 | Byrne | 340/961 X |
| 3,233,217 | 2/1966 | Bost, Jr. | 340/901 |
| 3,673,560 | 6/1972 | Barsh | 340/901 |
| 3,760,349 | 9/1973 | Keister | 340/902 |
| 4,241,328 | 12/1980 | Lobe | 340/474 |
| 4,438,429 | 3/1984 | Park | 340/901 |

OTHER PUBLICATIONS

IEEE Standard Dictionary of Electrical & Electronics Terms, 3rd Ed., N.Y., 1984, p. 955.

*Primary Examiner*—Hezron E. Williams
*Assistant Examiner*—Christine K. Oda
*Attorney, Agent, or Firm*—Roy A. Ekstrand

[57] ABSTRACT

An emergency vehicle alert system provides a transceiver for use in emergency vehicles and a receiver for use in non-emergency vehicles. The transceiver is operative in either a receive mode or a transceive mode at the user's choice. In the transceive mode, the transceiver alternates between emergency vehicle alert signal transmission and a receiving function in which the presence of other emergency vehicles may be detected. In the receive mode, the transceiver responds directly to received emergency vehicle alert signals from other vehicles in the same manner as the standard receiving unit. The transceiver produces a signal having encoded information which identifies the emergency vehicle type. The receiver receives and processes the emergency vehicle alert signal to identify the presence of an emergency vehicle and the type of vehicle doing the transmitting.

3 Claims, 5 Drawing Sheets

DETECT TRANS REQUEST
140

IS TRANSMISSION REQUESTED ?
141
Y
N
ENABLE RECEIVER
142
SWITCH ANTENNA TO REC
143
DELAY TIMER
144
ISSUE START REC
145
RECEIVER OPEN
146
IS TIME OUT ?
147
N
Y
IS TRANSMISSION REQUESTED ?
148
Y
N
DISABLE RECEIVER
149
ISSUE STOP RECV INST
150
SWITCH ANTENNA TO TRANS
151
DELAY TIMER
152
ENABLE TRANSMITTER
153
GENERATE ENCODED SIGNAL
154
TRANSMIT
155
START TIMER
156
IS TIME OUT ?
157
N
Y
DISABLE TRANSMITTER
158

ENABLE RECEIVE
170
DETECT NO SIG. COND
171
IS NO SIGNAL DETECTED
172
DETECT ALERT SIG.
173
IS ALERT SIGNAL DETECTED
174
N
Y
START WINDOW TIMER
175
COUNT SIG. PULSES
176
DETECT NO SIG. COND.
177
IS TIMER OUT
178
N
Y
IS NO SIG. DETECT
179
N
Y
COMPARE PULSE TO CODE
180
IS THIS AN ALERT ?
181
N
Y
IDENTIFY VEH. TYPE
182
OPERATE DISPLAY
183
IS AUDIBLE RECENT
184
Y
N
SOUND AUDIBLE
185
IS SIG. STILL PRES
186
Y
N
TERMINATE DISPLAY AND AUDIBLE
187

EMERGENCY VEHICLE ALERT SYSTEM

FIELD OF THE INVENTION

This invention relates generally to emergency vehicles and particularly to alert and warning systems used therein.

BACKGROUND OF THE INVENTION

As urban and suburban areas have become more and more developed and as population centralization in such urban and suburban areas has increased, these areas have become more and more congested and crowded. This concentration and its accompanying congestion has in turn brought increased traffic congestion and more and more crowded streets. Often such streets are lined on each side by relatively tall buildings or similar structures which limit visibility in many directions and often give rise to streets resembling "concrete canyons" which leave motorists driving on such streets with a forward and rearward view and little or no extended field of vision to detect the approach of potential hazards. For non-emergency type motorists, such congestion and limited field of view may be in some measure accommodated by reducing speed and approaching intersections of similarly restricted view streets at smaller speeds and with greater caution. Thus, for non-emergency motorists, these conditions of congested streets and limited vision may result in annoying and often stressful traffic slowdowns and increased travel times, but in general, remain within the motorist's control.

Emergency vehicles, however, are subject to a far different operating criteria due to the urgency which accompanies their travels throughout the congested urban and suburban areas. Under the urgency of the situation arising usually from the need for immediate care and action at some local within the urban or suburban areas, emergency vehicle drivers operate at higher speeds often at risk to themselves and others.

Emergency vehicles employ audible warning devices such as sirens or the like together with batteries of flashing lights to alert motorists to their approach. Motorists are, of course, required by law to pull over the side of the street and stop in order to give the right of way to such emergency vehicles and to avoid the danger of collision. While, flashing lights and audible warning systems have provided some effect, the limitations imposed upon such systems by crowded building structures close to streets have generally limited the effectiveness of flashing lights to vehicles directly within the emergency vehicle's path. Moreover, the development of automobiles with improved sound insulation and the pervasive use of air-conditioning and similar environmental controls within automobiles together with the tendency of motorists to use automotive sound systems providing music and the like while driving, have combined to greatly limit the effectiveness of audible alert devices such as sirens or the like.

Thus, under these conditions, emergency vehicle operators are often faced with the unenviable choice of either slowing down and thereby loosing response time or assuming the risk of collision and operating at high speeds in a high risk manner. In attempting to meet the need for more effective warning systems operating on behalf of emergency vehicles, practitioners in the art have attempted to develop supplemental systems which cooperate with and enhance the effectiveness of the traditional audible and flashing light alert systems. One such system involves the use of radio controlled or optically controlled traffic lights within the city streets. These systems vary somewhat but generally all include a radio energy or optical communication receiver at each intersection which is able to override the traffic light condition and impose stop signals to all traffic. A transmitting unit within the emergency vehicle broadcasts a control signal which is received and processed by the traffic control receives causing traffic to stop at intersections prior to the emergency vehicle approach.

Other systems have attempted to supplement the flashing light and audible alert systems of emergency vehicles with broadcast warnings usually operative in combination with the vehicle's radio.

While these systems may provide some improvement, they generally fail to reliably alert motorists to the impending approach of an emergency vehicle. In addition, such systems have not provided information as to the character of emergency vehicle approaching.

There remains, therefore, a continuing need in the art for evermore improved emergency vehicle alert systems which permit emergency vehicles to operate at high response speeds without unnecessarily endangering other emergency vehicles or non-emergency vehicles within the travel path.

SUMMARY OF THE INVENTION

Accordingly, it is a general object of the present invention to provide an improved vehicle alert system. It is a more particular object of the present invention to provide an improved emergency vehicle alert system which alerts both non-emergency vehicles as well as other emergency vehicles operating within a common travel area. It is a still more particular object of the present invention to provide an improved emergency vehicle alert system which identifies the type of emergency vehicle in the area of the user.

An emergency vehicle alert system comprises: a transceiver transmission means for transmitting an alert signal including an emergency vehicle type signal; and a receiver having reception means for receiving a transmitted alert signal from a second transceiver having a second emergency vehicle type signal therein, comparing the second type signal to the stored set of type signals and producing a vehicle type indication; alternating means for alternating the operation of the transmission means and the reception means; means for initiating a transmission request, means for operating the alternating means in response to the transmission request, and means for operating the reception means in the absence of a transmission request; and means independent of the alternating means for periodically interrupting the means for transmitting and operating the reception means notwithstanding a transmission request.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
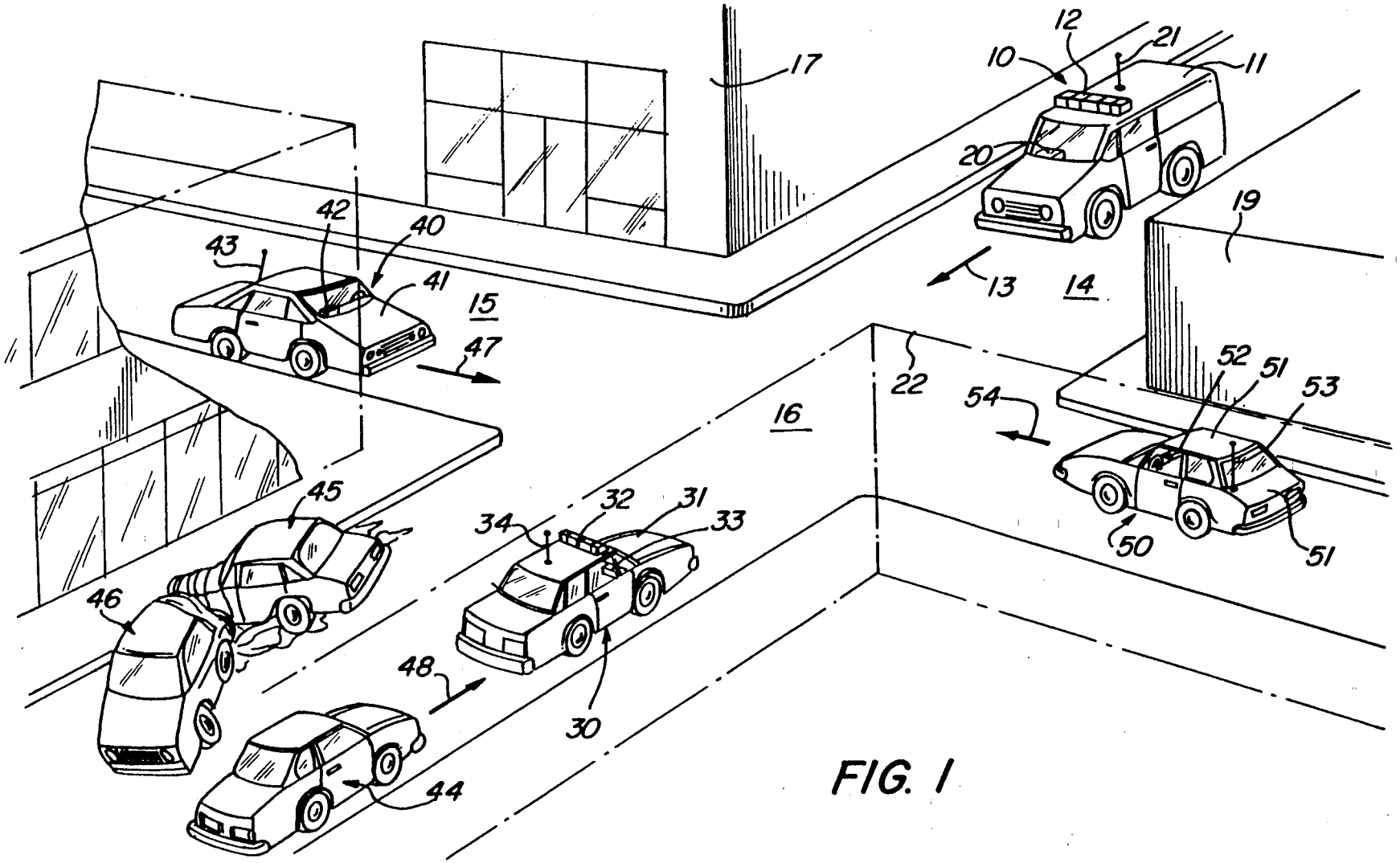
FIG. 1 sets forth a perspective view of an exemplary operating scene utilizing the present invention emergency vehicle alert system.

FIG. 1 sets forth a typical urban intersection in which a pair of streets generally referenced by numerals 14 and 15 intersect forming a common intersection generally referenced by numeral 16. In accordance with the typical urbanized or suburban environment, streets 14 and 15 and intersection 16 formed thereby are generally surrounded by a plurality of building structures 17, 18, 19 and 22. To better illustrate the traffic upon streets 14 and 15, building 22 is shown in dashed-line transparent depiction as is a corner portion of building 18. The important characteristic of buildings 17, 18, 19 and 22 is their tendency to obscure or block the vision of motorists operating upon streets 14 and 15.

In an exemplary intersection scenario which shows the advantages of the present invention system, a typical emergency vehicle generally referenced by numeral 10 includes a standard vehicle body and propulsion apparatus referenced by numeral 11. Vehicle 10 further includes the standard warning units which include flashing light array 12 and a source of audible alert such as a conventional siren (not shown). In accordance with the present invention, emergency vehicle 10 also includes an alert system transceiver generally referenced by numeral 20 constructed in accordance with the present invention set forth below in greater detail. Also, in accordance with the present invention, emergency vehicle 10 further includes a combination transmitting and receiving antenna 21. Emergency vehicle 10 is proceeding along street 14 in the direction indicated by arrow 13 and is approaching intersection 16.

A second emergency vehicle generally referenced by numeral 30 includes a conventional automobile body and propulsion system 31 and a conventional flashing light 32 as well as a conventional audible alert such as a siren or the like. Emergency 30 may, for example, be a standard police vehicle. In accordance with the present invention, emergency vehicle 30 is also equipped with a vehicle alert transceiver 33 constructed in accordance with the present invention and described below in greater detail as well as a combination transmitting and receiving antenna 34.

A non-emergency vehicle 50 comprises a conventional vehicle having a body 51 and conventional propulsion means. In accordance with the present invention, vehicle 50 also includes a vehicle alert receiver generally referenced by numeral 52 and described below in greater detail. In further accordance with the present invention, vehicle 50 also supports a receiving antenna 53. Vehicle 50 is proceeding in the direction indicated by arrow 54 along street 15 and is approaching intersection 16.

A non-emergency vehicle 40 includes a conventional body and operating means 41 and is proceeding along street 15 in the direction indicated by arrow 47. Vehicle 40 also includes a vehicle alert receiver 42 and a receiving antenna 43 constructed in the manner set forth below in greater detail.

A non-emergency vehicle 44 constructed in accordance with conventional automobile fabrication does not include a vehicle alert receiver such as those found in vehicles 40 and 50 and is proceeding in the direction indicated by arrow 48 along street 14. A pair of vehicles 45 and 46 are shown following a typical vehicular collision and are resting upon a portion of street 14 in the manner shown.

In accordance with the operation set forth below in greater detail, emergency vehicle 10 is proceeding along street 14 with utmost urgency and, as a result, is operating its conventional alert system which includes flashing lights 12 and a conventional audio alert siren or the like. In addition, however, and in accordance with the present invention, emergency vehicle 10 is also operating transceiver 20 which broadcasts an emergency vehicle alert signal using antenna 21 in all directions surrounding emergency vehicle 10.

Vehicles 40 and 50 are both non-emergency vehicles and are equipped with emergency vehicle alert receivers 42 and 52 respectively as well as receiving antennas 43 and 53 respectively. Thus, as emergency vehicle 10 broadcasts or transmits the emergency vehicle alert signal from antenna 21, receiving antennas 43 and 53 of non-emergency vehicles 40 and 50 receive the emergency vehicle alert signal which is processed by their respective emergency vehicle alert receivers 42 and 52 respectively. In the manner set forth below, the coded information signal within the transmitted alert signal from emergency vehicle 10 is processed by receivers 42 and 52 to indicate the approach of emergency vehicle 10 and to identify emergency vehicle 10 as to type of vehicle. For example, emergency vehicle 10 may be an ambulance in which case an indication on the display portions of receivers 42 and 52 set forth below provides a corresponding indication which prompts the operators of vehicles 40 and 50 to quickly take cautionary action and to more quickly locate emergency vehicle 10 once it comes into view.

Emergency vehicle 30 provides an example of a stationary use of the present invention emergency vehicle alert system in that emergency vehicle 30 is parked or stationary in the vicinity of the collision site of vehicles 45 and 46. In accordance with the present invention, the operator of emergency vehicle 30 maintains the operation of emergency vehicle alert transceiver 33 causing an emergency vehicle alert signal to be broadcast from antenna 34. Thus, as vehicles 40 and 50 approach the collision site of vehicles 45 and 46, their respective receivers will respond to the broadcast alert signal from emergency vehicle 30 and permit the cautionary change of speed and so on as well as alerting them to the identity of emergency vehicle 30.

In addition, the transceiver units within emergency vehicles 10 and 30 function in the manner set forth below in greater detail to respond to the received emergency vehicle alert signals from other emergency vehicles. Thus, as emergency vehicle 10 approaches the scene of the collision between vehicles 45 and 46, transceiver 20 responds to the alert signal broadcast by vehicle 30. Conversely, the transceiver within emergency vehicle 30 also receives and responds to the broadcast alert signal from emergency vehicle 10.

Thus, in accordance with the present invention system, emergency vehicles 10 and 30 are able to produce emergency vehicle alert signals which are received by non-emergency vehicles such as vehicles 40 and 50 to provide an effective alert warning. In addition, emergency vehicles 10 and 30 are also aware of each other's activity within the vicinity of intersection 16. In further addition, it should be noted that the present invention alert system is not limited to use within motor vehicles but may also be used upon bicycles or by others such as pedestrians, rollerskaters, skateboarders or the like.

By contrast, vehicle 44 which represents a non-emergency vehicle which is not equipped with the present invention emergency vehicle alert receiver is shown, for example, travelling in the direction of arrow 48 upon street 14. The driver of vehicle 44 is unable to receive the emergency vehicle alert signals and thus must rely solely upon the conventional flashing light arrays and audible warning systems of emergency vehicles 10 and 30. Thus, the driver of vehicle 44 is at a substantial disadvantage having limited visibility and no additional emergency vehicle alert to rely upon.

Figure 2:
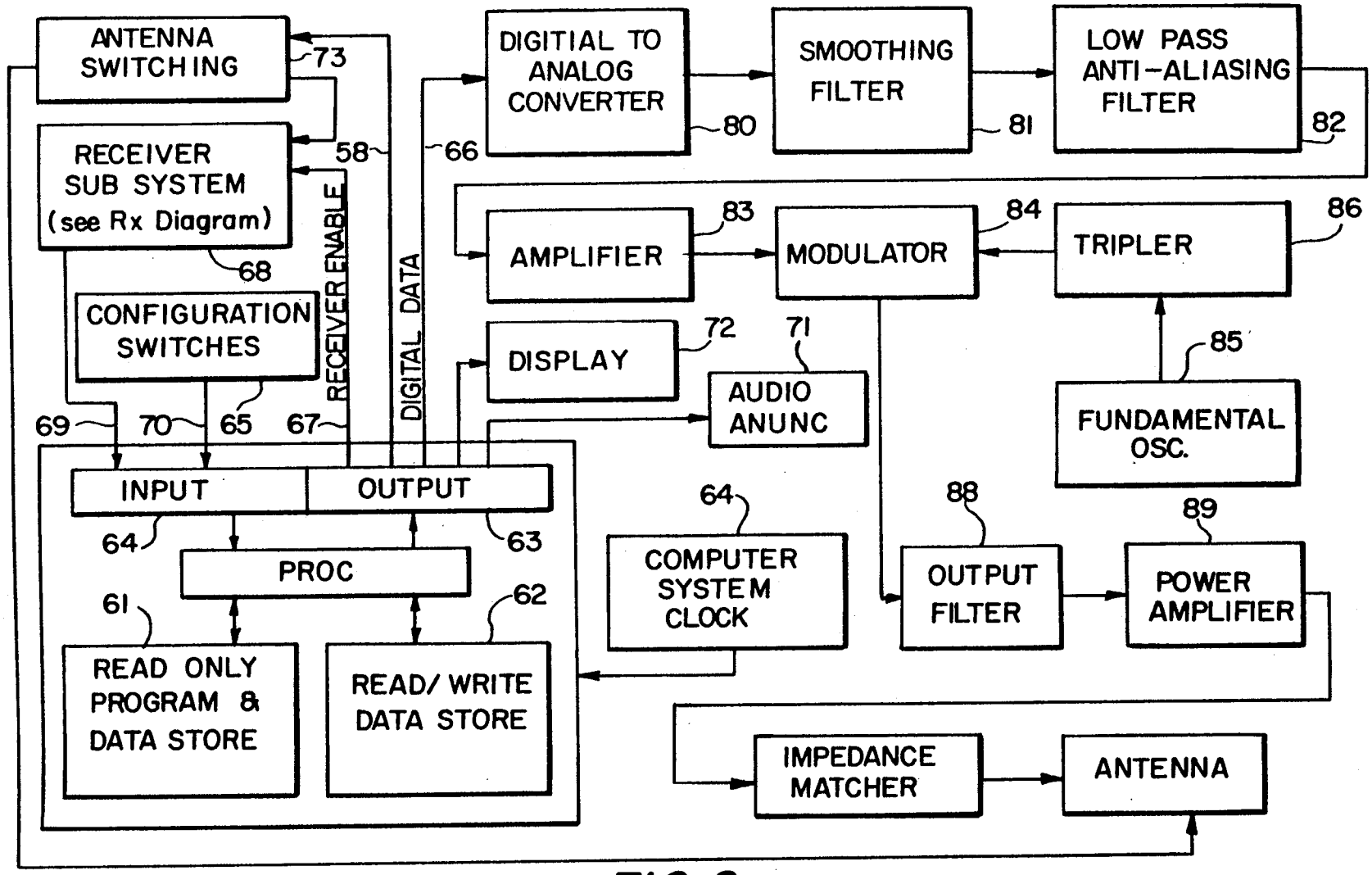
FIG. 2 sets forth a block diagram of a transceiver constructed in accordance with the present invention.

FIG. 2 sets forth a block diagram of the transceiver portion of the present invention emergency vehicle alert system such as transceiver 20 within emergency vehicle 10. A microcomputer 59 includes a microprocessor 60, a read-only memory 61 and a read/write memory 62 coupled to processor 60 in a bidirectional operative coupling. Microcomputer 59 further includes an output bus 63 and input bus 64 also coupled to processor 60. A clock circuit 64, constructed in accordance with conventional fabrication techniques, is coupled to microcomputer 59 and provides the basic clock signal for operating processor 60 as well as memories 61 and 62 and communication buses 63 and 64. Output bus 63 includes a digital data port 66 coupled to a digital to analog converter 80, a switching signal output 58 coupled to an antenna switching circuit 73 and a receiver enable output 67 coupled to a receiver subsystem 68. An output display 72 and an audio annunciator 71 are also coupled to output bus 63. Input bus 64 is coupled to a plurality of configurations switches 65 by a coupling 70 and is further coupled to receiver subsystem 68 by a coupling 69. The output of antenna switching circuit 73 is coupled to a switching input 74 of antenna 91.

Digital to analog converter 80 is coupled to a smoothing filter 81 which in turn is coupled to a low pass filter 82. The output of low pass filter 82 is coupled to an amplifier 83, the output of which is coupled to a modulator 84.

A fundamental oscillator 85 produces a fundamental mode signal which is coupled to a frequency tripler 86. The output signal of tripler 86 is applied to the carrier input of modulator 84. Modulator 84 comprises a frequency modulator and thus produces a frequency modulated output signal which is coupled to a power amplifier 89 by an output filter 88. An impedance matching network 90 couples the output of power amplifier 89 to antenna 91.

In operation, the user selects the operative mode of the present invention transceiver by manipulating configuration switches 65. For example, in the absence of a need to transmit a warning signal, the operator sets up configuration switches 65 to provide an input signal on input coupling 70 which is communicated by input bus 64 to processor 60. Processor 60 responds to the switch configuration to operate in a receiving mode and produces a corresponding output signal on output bus 63 which is coupled to receiver subsystem 68 by coupling 67. Correspondingly, processor 60 further provides an antenna switching signal which is coupled to antenna switching network 73 which in turn is operative to configure antenna 91 in a receiving mode. Thus, antenna 91 and antenna switching network 73 cooperate to couple received signals impinging antenna 91 to receiver subsystem 68. In accordance with the operation of receiver subsystem 68 set forth below in greater detail in FIG. 3, received signals are processed to produce input digital data recovered from received emergency vehicle alert signals via coupling 69 to microcomputer 59. In further accordance with the processing of received emergency vehicle alert signals set forth below in greater detail, processor 60 operates in conjunction with memories 61 and 62 to identify the presence of a received emergency vehicle alert signal as well as additional data such as vehicle type.

In the event the received signal applied to subsystem 68 and processed by microcomputer 59 corresponds to an emergency vehicle alert signal, audio annunciator 71 and display 72 are operated by processor 60 in the manner described below to alert the vehicle operator to the presence of an emergency vehicle within the area.

In the event the transceiver of FIG. 2 is operated in a transmitting mode in which the host vehicle is on an emergency operation, the operator reconfigures the transceiver using the switches within configuration switch array 65 to produce an alternative digital signal input to microcomputer 59. This input is received by processor 60 through input bus 64 and is processed to operate processor 60 and memories 61 and 62 in the transmitting mode described below in greater detail.

When operating in the transmitting mode, microcomputer 59 produces a coded digital signal which is coupled to digital to analog converter 80 by coupling 66 through output bus 63. Digital to analog converter 80 converts the digital data input to a corresponding analog signal which is successively filtered by filters 81 and 82 and thereafter amplified by amplifier 83. The amplified output of amplifier 83 is applied to the modulating input of modulator 84. Fundamental oscillator 85 produces a basic oscillating signal which is tripled in frequency to produce the desired RF carrier signal upon which the amplified output of amplifier 83 is modulated. Modulator 84 comprises a conventional frequency modulator producing an output signal having a carrier frequency corresponding to the output of tripler 86 which is frequency modulated in accordance with the modulating signal from amplifier 83. In accordance with an important aspect of the present invention, the digital data produced by processor 60 includes coded information which may be recovered in the manner set forth below by emergency vehicle alert system receivers to provide important data. While virtually any data may be communicated using this coded information, it has been found advantageous in the present invention system to provide data which identifies the type of emergency vehicle transmitting the alert signal. Thus, for example, processor 60 may produce a frequency tone corresponding to the preassigned frequency for an ambulance vehicle which, when modulated upon modulator 84, identifies the transmitting vehicle as an ambulance.

The modulated output signal is filtered by filter 88 to remove undesired harmonics and other undesired frequency signals and thereafter amplified by amplifier 89 and coupled to antenna 91 by an impedance matching network 90. It should be recalled that antenna 91 is configured in either a transmitting or receiving mode by the control of antenna switching network 73. Thus, once processor 60 receives the input information from configuration switches 65 indicating the use of a transmission mode, processor 60 produces a control signal on output 58 which causes antenna switching circuit 73 to configure antenna 91 in a transmit mode. Thus, the present invention emergency vehicle alert system transceiver utilizes a frequency coded signal in which a pure tone represents each of the available alert information sets. The microcomputer synthesizes the various tones using a look up table index and table increment in accordance with conventional microcomputer operation. A different increment for the look up table is applied to produce different tones and encode different alert type signals. It will be apparent to those skilled in the art that while the preferred embodiment of the present invention transceiver set forth in FIG. 2 utilizes frequency modulation to encode a pure tone signal, other types of information encoding may be utilized without departing from the spirit and scope of the present invention. It will also be apparent to those skilled in the art that the receiver shown in FIG. 2 is operable in either a receiving or listening mode in which the presence of additional emergency vehicles may be detected. Alternatively, the present invention transceiver may be operative in a transceived mode. While the transceived mode operation is set forth in greater detail, suffice it to note here that the transceived mode operates to alternate a transmitting function and receiving function in accordance with a predetermined format which permits the present invention system to maintain its capability to detect other emergency vehicle warning alerts while transmitting its own warning alert. In addition, it will be apparent to those skilled in the art that while FIG. 2 shows the operation of configuration switches operable by the user to determine the mode of system operation, the transceiver may, alternatively, be slaved to other warning and alert devices such as the flashing light or siren unit within the vehicle and thus automatically operate in combination therewith.

Figure 3:
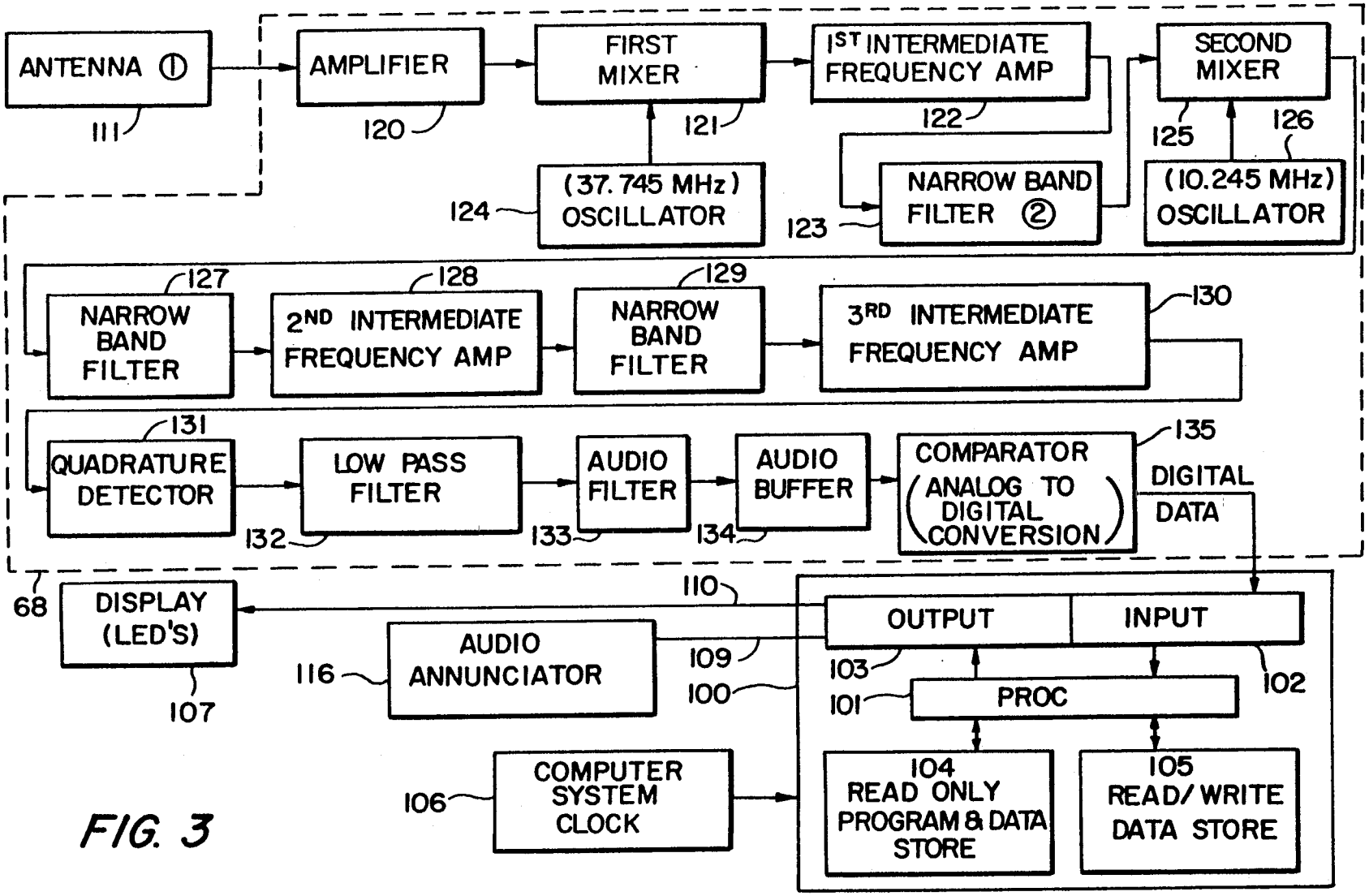
FIG. 3 sets forth a block diagram of a receiver constructed in accordance with the present invention.

FIG. 3 sets forth a block diagram of a receiver unit of the present invention vehicle alert system. It should be noted that the receiver shown in FIG. 3 corresponds to receivers within non-emergency vehicles such as receivers 42 and 52 within vehicles 40 and 50 respectively shown in FIG. 1. It should also be noted, however, that the portion of the receiver shown in FIG. 3 enclosed within dashed-line enclosure 68 corresponds to the receiver subsystem 68 of the transceiver shown in FIG. 2. Thus, while the descriptions of the operative components within enclosure 68 are described in conjunction with FIG. 3 to set forth the operation of the receiver unit, the operative descriptions thereof should be understood to apply equally well to receiver subsystem 68 of the transceiver of FIG. 2.

A microcomputer 100 is constructed in accordance with conventional fabrication techniques and includes a processor 101 having a read-only memory 104 and a read/write memory 105 coupled thereto. Microcomputer 100 further includes an input communication bus 102 and an output communication bus 103. A clock circuit 106 is operatively coupled to microcomputer 100 in accordance with conventional fabrication techniques. Output bus 103 is coupled to a display system 107 by connection 110 and an audio annunciator 116 by connection 109.

An antenna 111 is coupled to an amplifier 120 which in turn is coupled to one input of a first mixer stage 121. An oscillator 124 having a frequency higher than the modulating frequency used by the transceiver units of the present invention emergency vehicle transceivers is coupled to first mixer 121. The output of first mixer 121 is coupled to a second mixer by the series combination of a first intermediate frequency amplifier 122 and a narrow band filter 123. A second oscillator 126 is also coupled to second mixer 125, the output of which is coupled to a frequency selective amplifier chain formed by the series combination of a narrow band filter 127, a second intermediate frequency amplifier 128, a narrow band filter 129 and a third intermediate frequency amplifier 130. The filtered and amplified output of amplifier 130 is coupled to a quadrature detector 131. The output of quadature detector 131 is coupled to a comparator 135 by a low pass filter 132, an audio filter 133 and a buffer stage 134. Comparator 135 includes an analog to digital converter producing a digital data signal which is coupled to input 108 of input bus 102.

In operation, antenna 111 receives a transmitted emergency vehicle alert signal which is amplified by amplifier 120 and converted by first mixer 121 to an intermediate frequency signal. As mentioned above, the emergency vehicle alert system signal is frequency modulated upon a carrier of approximately twenty seven megahertz. Correspondingly, it has been found desirable to operate oscillator 124 approximately ten megahertz above the received carrier to produce an intermediate frequency signal of approximately ten megahertz. It will be apparent to those skilled in the art, however, that different frequency selections may be made without departing from the spirit and scope of the present invention. The intermediate frequency signal produced by mixer 121 is converted to a still lower frequency by the operation of second mixer 125 and oscillator 126. Oscillator 126 is selected to operate at a frequency slightly lower than the intermediate frequency signal output of first mixer 121. Thus, second mixer 125 produces a low frequency signal having the frequency modulated information corresponding to the coded output signal produced by the present invention transceivers. Filter 127 removes undesired harmonic signals from the output of mixer 125 after which intermediate frequency amplifiers 128 and 130 together with filter 129 cooperate to amplify and frequency select the frequency modulated information signal. Quadature detector 131 functions in accordance with conventional quadature detection operation to recover the frequency modulated signal from the low frequency intermediate frequency signal provided by amplifier 130. Low pass filter 132 removes undesired harmonics from the output of quadature detector 131. Audio filter 133 further removes undesired frequency components from the recovered signal while buffer 134 provides an appropriate signal source to drive comparator 135. Comparator 135 performs an analog to digital conversion of the audio frequency signal provided by buffer 134 and produces a digital data output signal which corresponds to the recovered audio signal. Processor 101 compares the digital data signal at input 108 from comparator 135 to the stored coded signal samples within memories 104 and 105 to determine whether or not the recovered data signal corresponds to a recognizable emergency vehicle indicating signal. Once the processor has identified the presence of a recovered emergency vehicle alert signal and identified the type of emergency vehicle indicated thereby, processor 101 produces output signals which are coupled by output bus 103 to operate annunciator 106 and display 107. Display 107 includes a conventional display unit such as a light emitting diode display or the like which provide visual information indicating the presence of type of emergency vehicle detected. It may be desirable in some systems to utilize displays which provide alphabetic characters spelling out the name of vehicle detected or, alternatively, illuminate selected icons or other vehicle indicators. Similarly, audio annunciator 116 may, in its simplest form, comprise an audible alarm or other sound producing unit indicating the presence of a detected emergency vehicle.

Figure 4:
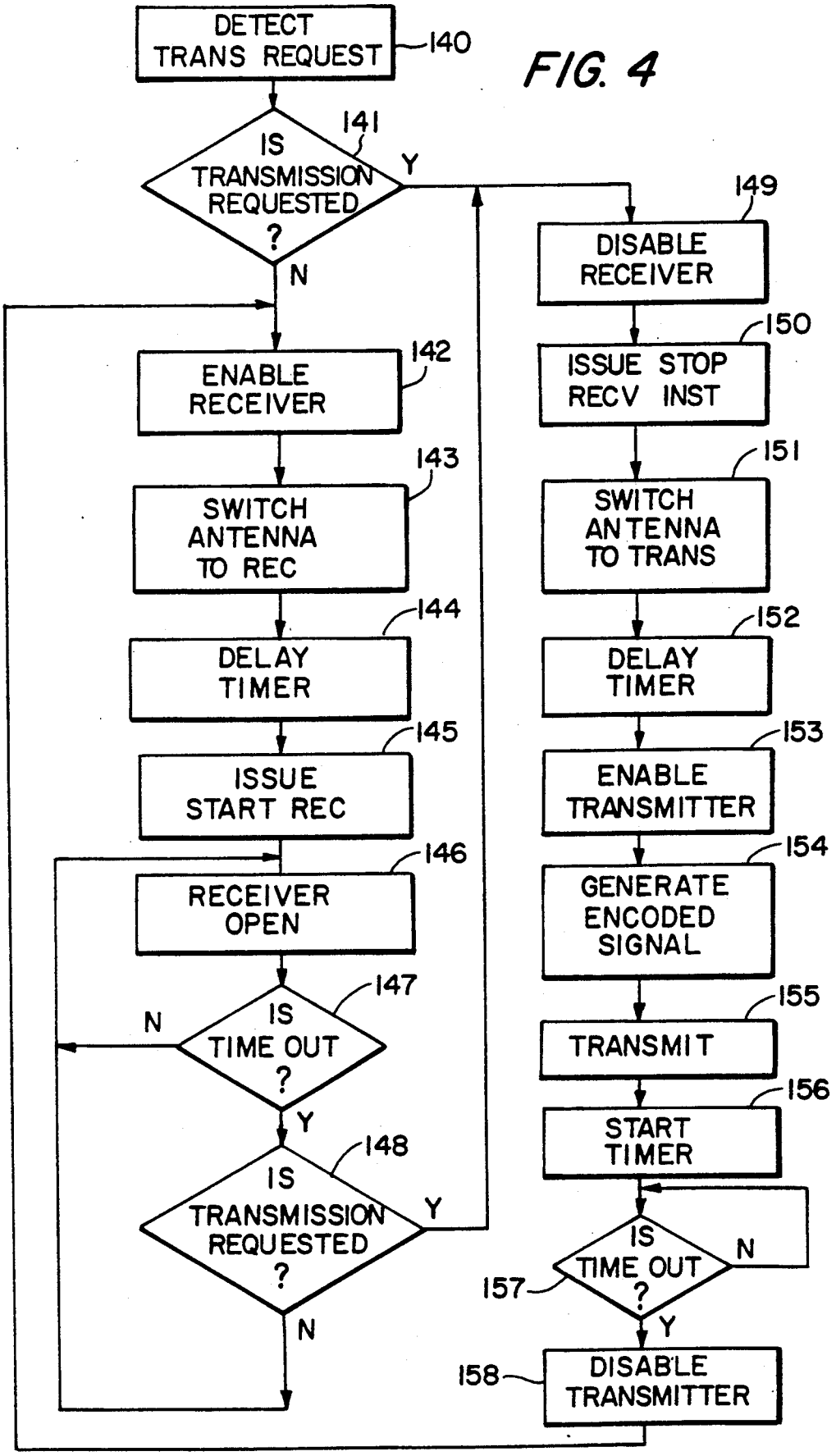
FIG. 4 sets forth a flow diagram of the operation of the present invention transceiver shown in FIG. 2.

FIG. 4 sets forth a flow diagram of the transceiver shown in FIG. 2. Operation initially begins at step 140 in which a check is made for transmission request by the operator. At step 141, a determination is made as to whether transmission request has been received. If transmission request has been received, the operation moves to a step 149 in which the receiver is disabled. In the absence of a transmission request, the operation moves to step 142 in which the receiver is enabled and thereafter to step 143 in which the antenna is switched to the received signal path. Thereafter, at step 144, a delay timer is operative to provide sufficient time to switch the antenna. Following the completion of the delay interval at step 144, the operation moves to step 145 in which a "start receive" signal is provided to the transceiver processor. In response, at a step 146, the processor opens the receiver to accept received signals. Next, the operation moves to a step 147 in which a determination as to whether the delay time has past. If the delay time has not past, the receiver returns to step 146. If, however, the time delay is complete, the operation moves to step 148 in which a determination is made as to whether a transmission request has been received. In the absence of a transmission request, the system returns to step 146 and will cycle through steps 146, 147 and 148 until a transmission request is received and thus maintain the transceiver in a receive mode. Once a transmission request has been found at step 148, the system moves to step 149 at which the receiver is disabled. Thereafter, at step 150 and 151, a "stop receive" command is issued to the processor and the antenna is switched to the transmitting path. A step 152, a time delay is implemented to permit the completion of antenna switching. Thereafter, the system moves to step 153 in which the transmitter is enabled and thereafter to step 154 in Which an encoded signal indicative of the type of emergency vehicle within which the transceiver is operative is produced. Thereafter, the signal is transmitted at a step 155 and a timer is started at step 156. At step 157, a determination is made as to whether a predetermined time interval has past. Once the time interval has past, the system moves to step 158 disabling the transmitter afterwhich the system returns to step 142 and the above-described cycle is repeated.

Thus, the transceiver is operative in the manner described above to remain in the receive mode until a transmission request is received. Once transmission is initiated, a time interval for transmission is timed afterwhich transmission is again terminated and the system returns to the received mode and alternates therebetween until the transmission request ceases afterwhich the transceiver remains in the received mode.

Figure 5:
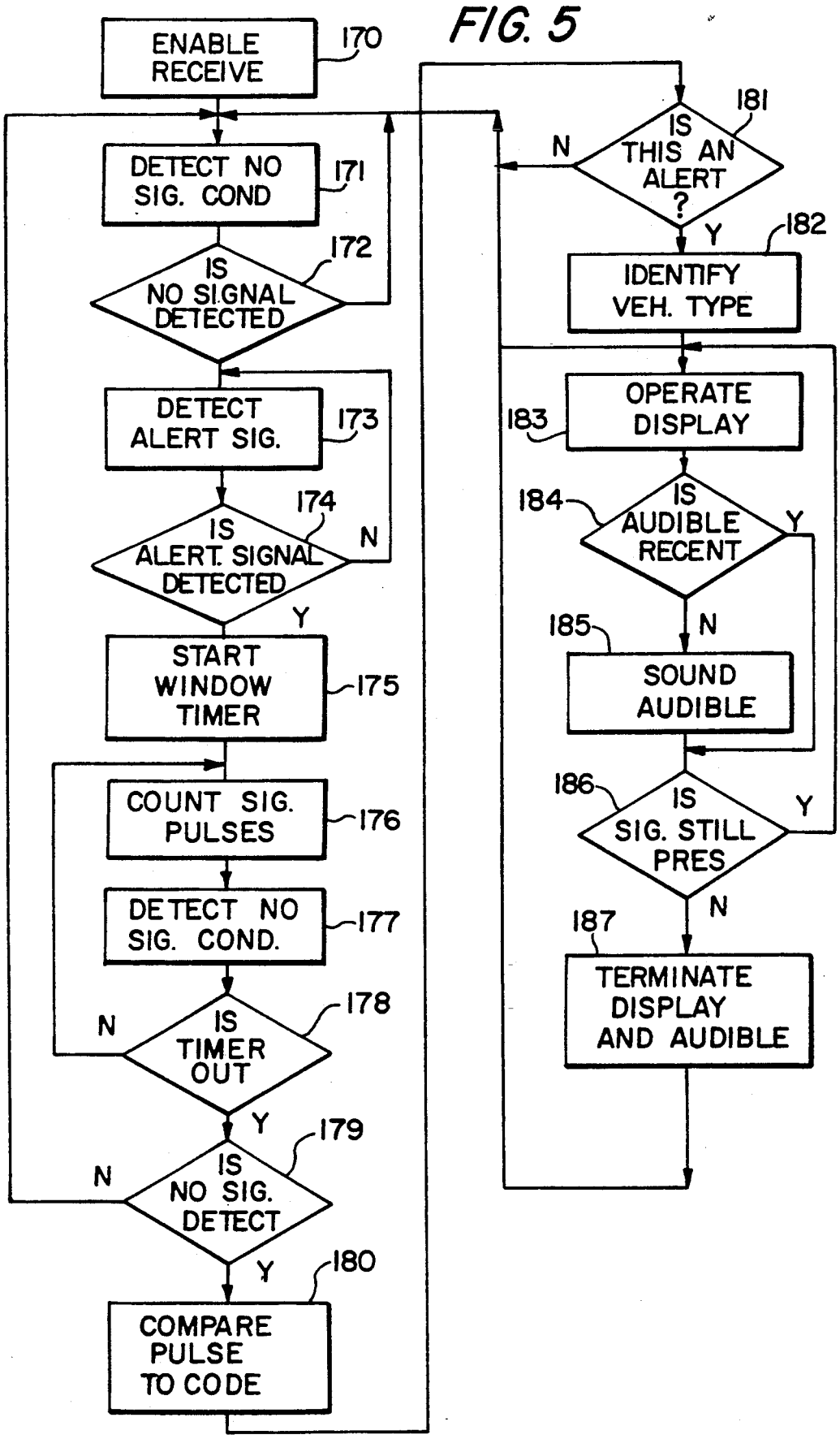
FIG. 5 sets forth a flow diagram of the operation of the present invention receiver shown in FIG. 3.

FIG. 5 sets forth a flow diagram of the receiver portion the present invention emergency vehicle alert system set forth in FIG. 3. Initially, at step 170, the receiver is enabled afterwhich the system looks for a no signal condition at step 171. The system then determines the existence of a no signal condition at step 172 and returns to step 171 until a no signal condition is detected. Thereafter, the system moves to a step 173 in which a determination is made as to the presence of an alert signal. If no alert signal is detected, the system returns to step 173 until an alert signal is detected at step 174. Once an alert signal is detected, the system moves through steps 175 through 177 to initiate a timing window and count the signal pulses during the window timing until a no signal condition is detected at step 177. Thereafter, the system determines at step 178 whether the timing window is complete. Once the timing window is determined to be complete, the system determines at step 179 whether a no signal condition has been detected following or during the timing window. If a no signal condition is not detected, the system assumes an erroneous signal and returns to step 171. If, however, a no signal condition has been detected, the system moves to step 180 and 181 in which a determination is made as to whether the pulse count during the window corresponds to an alert signal. If no alert signal is found, the system returns to step 171. If an alert signal is found, the system moves to step 182 in which the code is examined to determine emergency vehicle type. Thereafter, the system moves to step 183 in which the visual display is operated. At step 184, a determination is made as to whether audible alarm has been recently sounded. In the event no audible alarm has been recently sounded, the system sounds an audible alarm in step 185 and thereafter determines at step 186 whether alert signal continues to be present. If, however, at step 184 a determination is made that audible alarm has been sounded within a predetermined time interval, the system moves directly to step 186 avoiding again sounding the audible alarm to minimize user annoyance with repeated alarms. Thereafter, a determination is made at step 186 as to whether alert signal continues to be present. If alert signal is present, the system returns to step 183 and display operation is maintained. If, however, alert signal is no longer present, the system moves to step 187 terminating display and audible alarm and thereafter returning to step 171.

Thus, the receiver portion the present invention is operative to detect emergency vehicle alert signals and determine form the coded information therein the type of emergency vehicle from which the signals are transmitted. The system also avoids unnecessary and annoying repeated audible alarms by implementing a predetermined time interval between audible alarms while maintaining the operation of the visual display to continue the warning alert to the user.

What has been shown is an improved emergency vehicle alert system which provides a coded emergency vehicle alert signal receivable by both emergency vehicle and non-emergency vehicles. The coded information within the alert signal identifies the type of emergency vehicle transmitting the signal and thereby aids the user in locating and identifying the transmitting emergency vehicle.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An emergency vehicle alert system comprising:

a transceiver having transmission means for transmitting an alert signal including an emergency vehicle type signal;

a receiver having means for storing a set of vehicle type signals, reception means for receiving a transmitted alert signal from a second transceiver having a second emergency vehicle type signal therein, and processor means for comparing said second emergency vehicle type signal to said stored set of vehicle type signals and producing a vehicle type indication;

alternating means for alternating the operation of said transmission means and said reception means;

means for initiating a transmission request, means for operating said alternating means in response to said transmission request, and means for operating said reception means in the absence of said transmission request; and interrupt means independent of said alternating means for periodically interrupting said means for transmitting and operating said reception means, said interrupt means overriding said means for initiating a transmission request.

2. The emergency vehicle alert system as set forth in claim 1 wherein said emergency vehicle type signal includes a fixed frequency tone.

3. The emergency vehicle alert system as set forth in claim 2 wherein said alert signal includes a carrier signal having said fixed frequency tone frequency modulated thereon.

* * * * *